US007455394B2

(12) United States Patent
Sakaida et al.

(10) Patent No.: US 7,455,394 B2
(45) Date of Patent: Nov. 25, 2008

(54) INKJET HEAD

(75) Inventors: Atsuo Sakaida, Gifu (JP); Hisamitsu Sakai, Kagoshima (JP); Hiroshi Aida, Kagoshima (JP); Shin Ishikura, Kagoshima (JP)

(73) Assignees: Brother Kogyo Kabushiki Kaisha, Nagoya-shi, Aichi-ken (JP); Kyocera Corporation, Kyoto-shi, Kyoto (JP)

( * ) Notice: Subject to any disclaimer, the term of this patent is extended or adjusted under 35 U.S.C. 154(b) by 424 days.

(21) Appl. No.: 11/234,378

(22) Filed: Sep. 26, 2005

(65) Prior Publication Data

US 2006/0066691 A1 Mar. 30, 2006

(30) Foreign Application Priority Data

Sep. 30, 2004 (JP) ..... 2004-287720

(51) Int. Cl.
*B41J 2/045* (2006.01)

(52) U.S. Cl. ..... 347/71

(58) Field of Classification Search ..... 347/45, 347/68, 70–72
See application file for complete search history.

(56) References Cited

U.S. PATENT DOCUMENTS 6,866,366 B2 * 3/2005 Sasaki et al. ..... 347/45
7,244,389 B2 * 7/2007 Iwashita et al. ..... 264/614
2003/0156167 A1 8/2003 Sakaida et al.
2004/0104975 A1 6/2004 Furuhata
2004/0218018 A1 11/2004 Sakaida et al.

FOREIGN PATENT DOCUMENTS

| | | |
|---|---|---|
| CN | 1502469 A | 6/2004 |
| JP | 6-106724 | 4/1994 |
| JP | 2002-248761 | 9/2002 |
| JP | 2003-341056 | 12/2003 |
| JP | 2004-160967 | 6/2004 |

OTHER PUBLICATIONS

Notification of First Office Action dated Dec. 7, 2007 in Chinese Application No. 2005-10108773.2 and English translation thereof.

* cited by examiner

*Primary Examiner*—An H Do
(74) *Attorney, Agent, or Firm*—Banner & Witcoff, Ltd

(57) ABSTRACT

An inkjet head has: a channel unit having a plurality of nozzles and a plurality of pressure chambers respectively communicating with the nozzles; and an actuator unit on the channel unit and having a piezoelectric sheet, a plurality of individual electrodes respectively arranged to positionally correspond to the pressure chambers respectively and a common electrode sandwiching the piezoelectric sheet together with the plurality of individual electrodes. The actuator unit has a thickness of 20 μm to 100 μm and a surface roughness of the end face of the actuator unit including an intersection with channel unit and the actuator unit is 0.15 μm to 0.5 μm, and at least part of the end face is sealed by a resin film.

11 Claims, 12 Drawing Sheets

INKJET HEAD

BACKGROUND OF THE INVENTION

1. Field of the Invention

The present invention relates to an inkjet head comprising nozzles that discharge ink.

2. Description of the Related Art

An inkjet head distributes ink supplied from an ink tank to a plurality of pressure chambers. Ink that is distributed to the pressure chambers is pressurized by actuators and discharged from nozzles communicating with these pressure chambers. Piezoelectric elements including piezoelectric ceramic may be employed as the actuators. Japanese Patent Application Laid-open No. 2003-341056 (FIG. 3, paragraph number 0066; hereinafter referred to as "Patent Document 1") discloses a technique wherein, in an inkjet head employing piezoelectric elements as actuators, the side face of a piezoelectric element is covered by adhesive that is used to stick together the piezoelectric element and a channel-forming substrate in which pressure chambers are formed. With the technique disclosed in Patent Document 1, damage to the piezoelectric elements caused by the external environment can be easily and reliably prevented.

Also, Japanese Patent Application Laid-open No. 2004-160967 (FIG. 11; hereinafter referred to in "Patent Document 2") discloses an inkjet head in which a plurality of actuator units respectively provided with a large number of actuators are stuck onto a channel unit comprising a large number of nozzles and a large number of pressure chambers. Such actuator units comprise a piezoelectric sheet spanning a large number of pressure chambers, a large number of individual electrodes arranged to positionally correspond to pressure chambers respectively, and common electrodes sandwiching the piezoelectric sheet together with the large number of individual electrodes. The individual electrodes can be arranged with high density by employing an actuator unit as in Patent Document 2.

SUMMARY OF THE INVENTION

Patent Document discloses no technique whereby covering of a wide range of the end face of the piezoelectric element with adhesive can be facilitated and adhesion of adhesive to the upper face (face opposite to the face that is stuck onto the channel-forming substrate) of the piezoelectric elements can be made more difficult. Consequently, when the technique described in Patent Document 1 is applied to an inkjet head having actuator units as described in Patent Document 2, exposed regions may be produced in which a wide range of the end faces of the actuator units is not covered by adhesive, and this may result in impairment of at least one of the electrical insulation properties, resistance to humidity or mechanical strength. Furthermore, it is possible for adhesive to adhere to the upper face of the actuator units, leading to obstruction of drive of the actuator units.

Accordingly, an object of the present invention is to provide an inkjet head wherein covering of a wide range of the end face of the actuator units with a resin film such as an adhesive film can be facilitated and formation of adhesive film on the upper surface of the actuator units can be made more difficult.

An inkjet head according to an aspect of the present invention has a channel unit having a plurality of nozzles and a plurality of pressure chambers respectively communicating with the nozzles, and an actuator unit stuck onto the channel unit and having a piezoelectric sheet, a plurality of individual electrodes arranged to positionally correspond to the pressure chambers respectively and a common electrode sandwiching the piezoelectric sheet together with the plurality of individual electrodes. The actuator unit has a thickness of 20 μm to 100 μm. Also, the surface roughness of the end face of the actuator unit including the intersection with the channel unit is 0.15 μm to 0.5 μm. In addition, at least a part of the end face is sealed by a resin film.

DESCRIPTION OF THE PREFERRED EMBODIMENTS

Preferred embodiments of the present invention are described below with reference to the drawings.

First Embodiment

Figure 1:
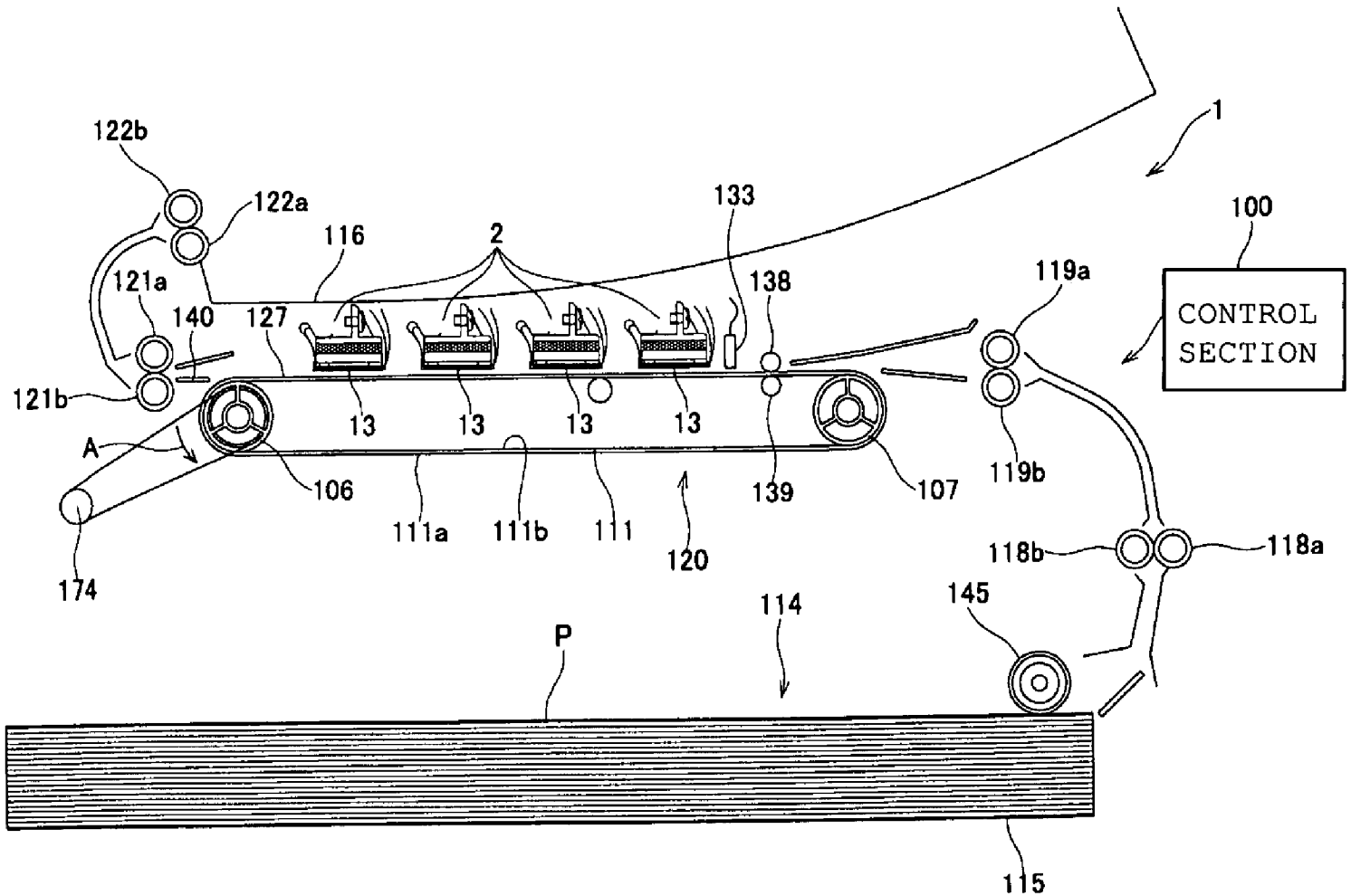
FIG. 1 is a constructional diagram of an inkjet printer including an inkjet head according to a first embodiment of the present invention.

First of all, an inkjet head according to a first embodiment of the present invention will be described. FIG. 1 shows a printer 1 including an inkjet head 2 according to this embodiment. The printer shown in FIG. 1 is a line head type color inkjet printer having four fixed inkjet heads 2 of rectangular shape in plan view elongated in a direction orthogonal to the plane of FIG. 1. The printer 1 is provided with a paper feed device 114 at the bottom in the Figure, a paper receiving section 116 at the top in the Figure and a paper feed unit 120 at the middle in the Figure, respectively. In addition, the printer 1 comprises a control section 100 that controls the operation of these.

The paper feed device 114 comprises a paper sheet accommodating section 115 capable of accommodating a plurality of stacked rectangular printing paper sheets P and paper feed roller 145 that feeds the uppermost sheet of printing paper P in the paper sheet accommodating section 115, one sheet at time, to the feed unit 120. The printing paper sheets P are accommodated in the paper sheet accommodating section 115 so as to be fed in the direction parallel to their long sides. Two pairs of feed rollers 118*a*, 118*b* and 119*a*, 119*b* are arranged along the feed path between the paper sheet accommodating section 115 and the feed unit 120. Printed paper sheets P that are discharged from the paper feed device 114 are fed upwards in FIG. 1 by the feed rollers 118*a*, 118*b* with one of their short sides constituting a leading-edge and are then fed to the left toward the feed unit 120 by the feed rollers 119*a*, 119*b*.

The feed unit 120 comprises an endless feed belt 111 and two belt rollers 106, 107 on which a feed belt 111 is wound. The length of the feed belt 111 is adjusted to a length such that the prescribed tension of the feed belt 111 that is wound on the two belt rollers 106, 107 is generated. Two mutually parallel planes respectively including the common tangents of the belt rollers 106, 107 are formed on the feed belt 111. Of these two planes, the plane that is opposite to the inkjet head 2 constitutes a feed face 127 for the printing paper sheets P. A printing paper sheet P that has been fed from the paper feed device 114 is fed along the feed face 127 formed on the feed belts 111 whilst being subjected to printing by the inkjet head 2 on its upper face (printing face), until it reaches the paper receiving section 116. A plurality of printing paper sheets P on which printing has been performed are stacked in the paper receiving section 116.

The four inkjet heads 2 have respective head units 13 at their lower ends. As will be described, in each head unit 13, four actuator units 21 are stuck together (see FIG. 2 and FIG. 4) by means of adhesive, with a channel unit 4. The channel unit is provided with individual ink channels 32 containing pressure chambers 10 that communicate with nozzles 8 respectively. The actuator unit can apply pressure to the ink within the desired pressure chamber 10 among a large number of pressure chambers 10. Also, an FPC (flexible printed circuit: not shown) that supplies a printing signal thereto is stuck onto each of the actuator units 21.

The head units 13 have rectangular parallelepiped shapes (see FIG. 2) elongated in the direction orthogonal to the plane of FIG. 1. The four head units 13 are arranged in mutually adjacent fashion along the left/right direction in the plane of FIG. 1. A large number of nozzles 8, each having minute diameter, are provided (see FIG. 3) at the bottom faces (ink discharge faces) of the four head units 13. The color of the ink that is discharged from the nozzles 8 is one or other of magenta (M), yellow (Y), cyan (C) or black (K); the color of the ink that is discharged from the large number of nozzles 8 belonging to a single head unit 13 is the same. Ink of mutually different colors selected from the four colors of magenta, yellow, cyan and black is discharged from the large number of ink discharge ports belonging to the four head units 13.

A slight gap is formed between the bottom face of the head unit 13 and the feed face 127 of the feed belt 111. The printing paper P is fed from right to left in FIG. 1 along a feed path passing through this gap. A desired color image corresponding to the image data is formed on the printing paper P by discharge of ink from the nozzles 8 towards the upper surface of the printing paper P when the printing paper P passes through sequentially below the four head units 13.

The two belt rollers 106, 107 contact the inner peripheral face 111*b* of the feed belt 111. Of the two belt rollers 106, 107 of the feed unit 120, the belt roller 106 that is positioned downstream of the feed path is connected with a feed motor 174. The feed motor 174 is driven in rotation under the control of a control section 100. The other belt roller 107 is a subordinate roller that is rotated by the rotary force that is supplied thereto from the feed belt 111 with rotation of the belt roller 106.

In the vicinity of the belt roller 107, nip rollers 138 and 139 are arranged so as to sandwich the feed belt 111. The nip roller 138 is biased downwards by a spring, not shown, such that the printing paper P that is supplied to the feed unit 120 is pressed onto the feed face 127. Also, the nip rollers 138 and 139 sandwich the printing paper P together with the feed belt 111. In this embodiment, the printing paper P is securely held by tacky adhesion to the feed face 127 by subjecting the outer peripheral face of the feed belt 111 to treatment with silicone rubber having tacky adhesive properties.

A separating plate 140 is provided to the left of the feed unit 120 in FIG. 1. The right-hand end of the separating plate 140 enters between the printing paper P and the feed belt 111, thereby separating the printing paper P that was attached by tacky adhesion to the feed face 127 of the feed belt 111 from the feed face 127.

Two pairs of feed rollers 121*a*, 121*b* and 122*a*, 122*b* are arranged between the feed unit 120 and paper receiving section 116. The printing paper P that is discharged from the feed unit 120, with one of its short sides constituting a leading edge, is fed upwards in FIG. 1 by the feed rollers 121*a*, 121*b* and is fed to the paper receiving section 116 by the feed rollers 122*a*, 122*b*.

A paper sensor 133 constituted by an optical sensor and comprising a light-emitting element and a photodetector element is arranged between the nip roller 138 and the most upstream inkjet head 2 in order to detect the leading-edge position of the printing paper P on the feed path.

Figure 2:
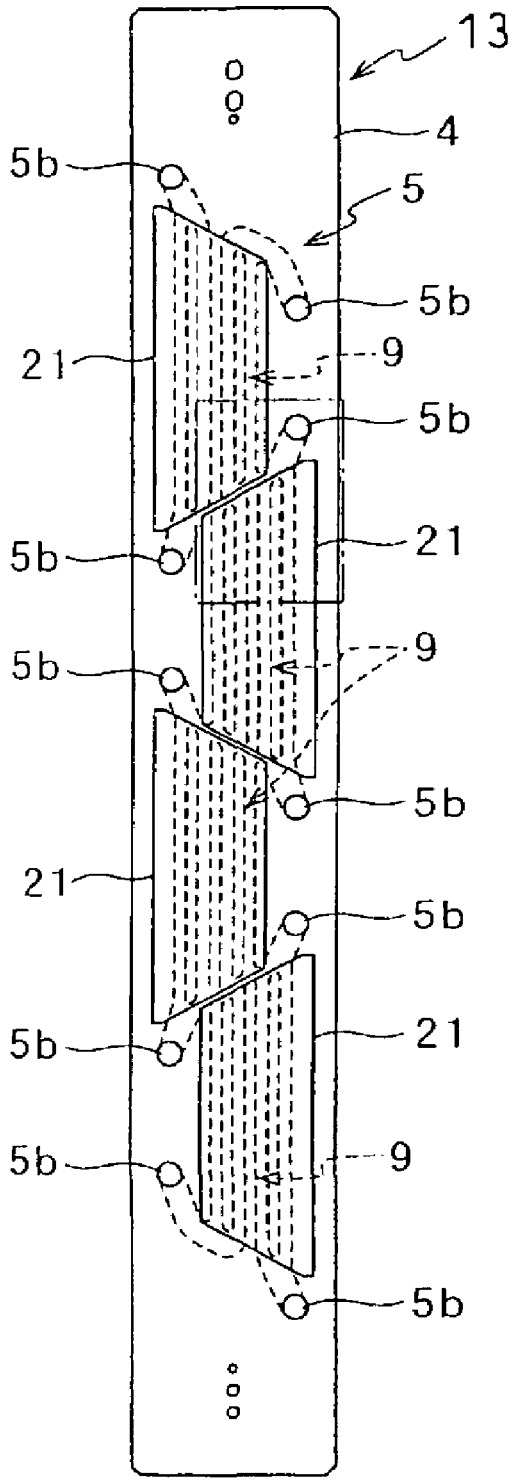
FIG. 2 is a plan view of a head unit shown in FIG. 1.
Figure 3:
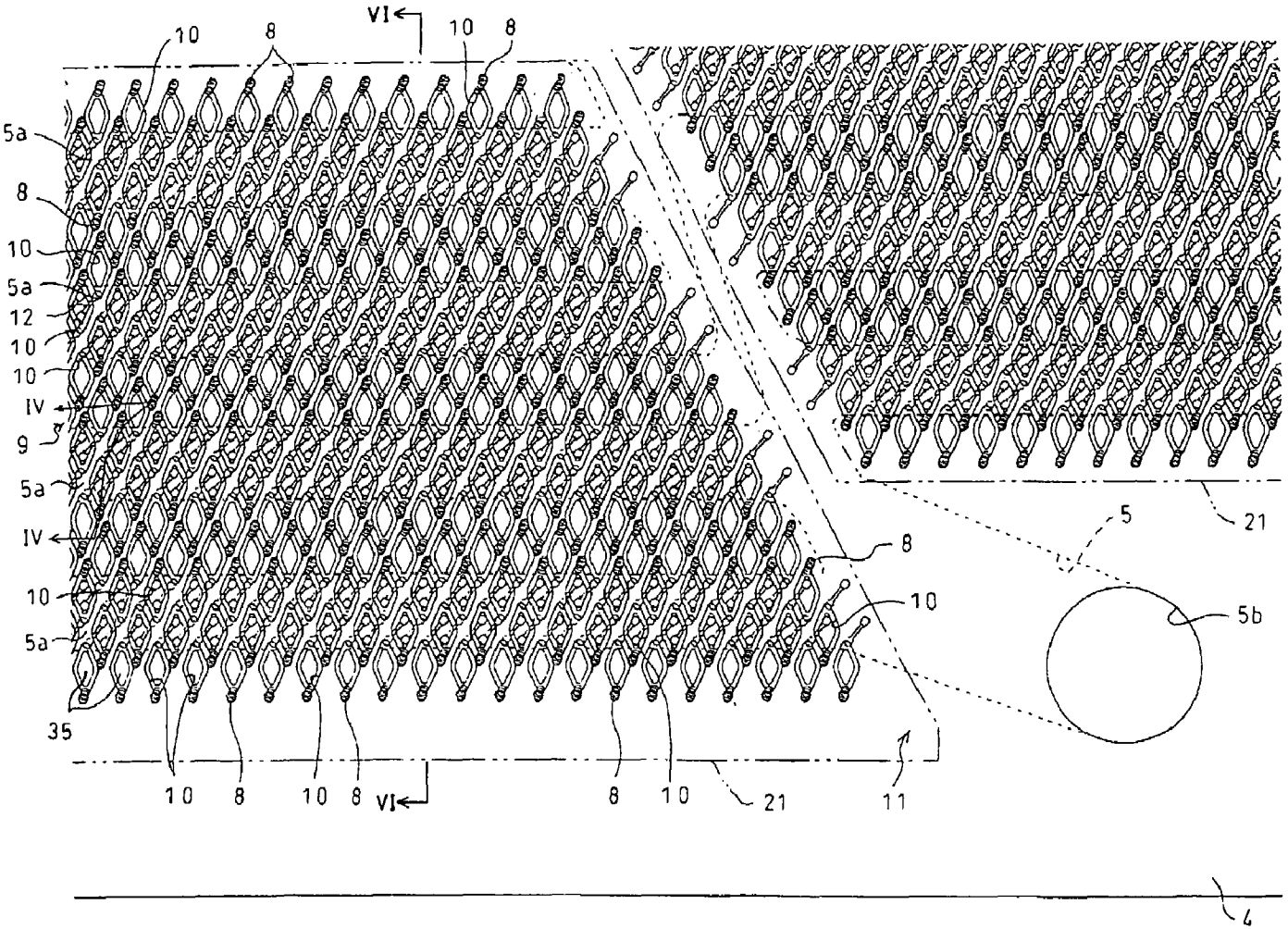
FIG. 3 is an enlarged view of a region defined by a single dotted chain line depicted in FIG. 2.

Next, a head unit 13 will be described in detail. FIG. 2 is a plan view of a head unit 13 as shown in FIG. 1. FIG. 3 is an enlarged plan view of the block defined by the single dotted chain line in FIG. 2. As shown in FIG. 2 and FIG. 3, the head unit 13 comprises a channel unit 4 provided with a large number of pressure chambers 10 constituting four pressure chamber groups 9 and a large number of nozzles 8 respectively communicating with the pressure chambers 10. Four trapezoidal actuator units 21 arranged in two rows in zigzag fashion are stuck onto the upper face of the channel unit 4. In more detail, the actuator units 21 are arranged such that their parallel opposite sides (upper side and lower side) run along the longitudinal direction of the channel unit 4. Also, corresponding inclined sides of adjacent actuator units 21 overlap in the width direction of the channel unit 4.

The undersurface of the channel unit 4 positionally corresponding to the region where the actuator unit 21 is stuck on constitutes an ink discharge region. As shown in FIG. 3, a large number of nozzles 8 are regularly arranged on the surface of the ink discharge region. A large number of pressure chambers 10 are arranged in matrix fashion on the upper face of the channel unit 4 and a single pressure chamber group 9 is constituted by a plurality of pressure chambers 10 present in the region facing the region where one actuator unit 21 is stuck on the upper face of the channel unit 4. As will be described, one individual electrode 35 formed on the actuator unit 21 positionally corresponds to faces each pressure chamber 10.

Manifold channels 5 constituting a common ink chamber and auxiliary manifold channels 5*a* constituting branch channels thereof are formed in the channel unit 4. Four auxiliary manifold channels 5*a* extending in the longitudinal direction of the channel unit 4 are provided to overlap each ink jet discharge region in plan view. The apertures 5*b* of the manifold channels 5 that are provided on the upper face of the channel unit 4 are joined with an ink outlet channel, not shown. Ink is therefore supplied to the manifold channels 5 and auxiliary manifold channels 5*a* through the ink outlet channel from an ink tank, not shown.

The nozzles 8 communicate with the auxiliary manifold channels 5*a* through apertures 12 and pressure chambers 10, which are substantially rhombus-shaped in plan view. The nozzles 8 contained in the four mutually adjacent nozzle rows that extend in the longitudinal direction of the channel unit 4 communicate with the same auxiliary manifold channel 5*a*. It should be noted that, in FIG. 2 and FIG. 3, in order to facilitate understanding of the drawing, the actuator unit 21 is depicted in double-dotted chain lines and the pressure chambers 10 (pressure chamber group 9) and actuator 12, which should be depicted by broken lines as being provided below the actuator unit 21, are depicted with continuous lines.

The large number of nozzles 8 that are formed in the channel unit 4 are formed in positions such that the projection points obtained by projecting these nozzles 8 onto an imaginary line extending in the longitudinal direction of the channel unit 4 are arranged at equal intervals at 600 dpi.

Figure 4:
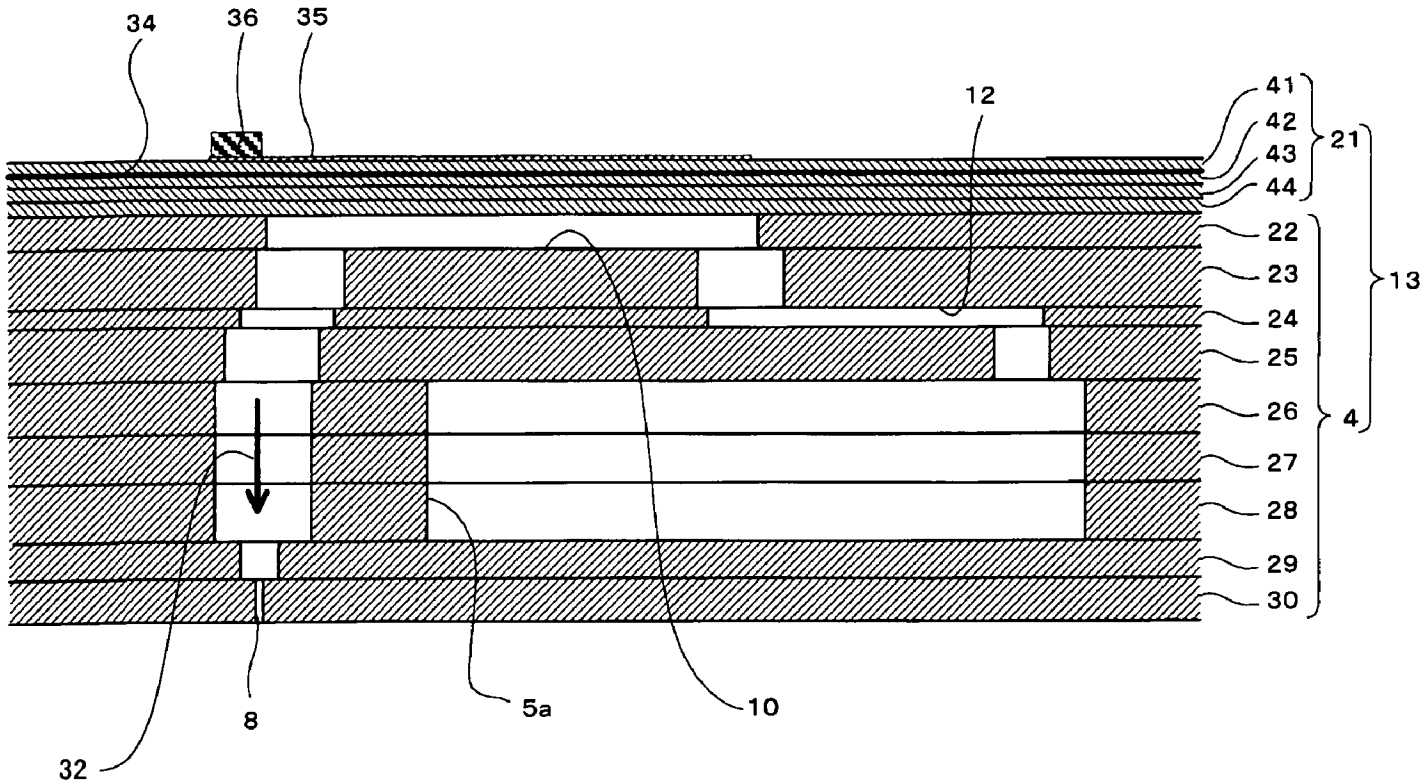
FIG. 4 is a cross-sectional view taken along the line IV-IV of FIG. 3.

The cross-sectional structure of the head unit 13 will now be described. FIG. 4 is a cross-sectional view taken along the line IV-IV of FIG. 3. As shown in FIG. 4, the head unit 13 is constituted by sticking together channel units 4 and actuator units 21. A channel unit 4 has a laminated structure obtained by laminating, from the top, a cavity plate 22, base plate 23, aperture plate 24, supply plate 25, manifold plates 26, 27, 28, cover plate 29 and nozzle plate 30.

The cavity plate 22 is a metal plate provided with a large number of substantially rhombus-shaped holes constituting pressure chambers 10. The base plate 23 is a metal plate provided with communicating holes for effecting communication of the pressure chambers 10 and apertures 12 corresponding thereto and a large number of communicating holes for effecting communication of the pressure chambers 10 and nozzles 8 corresponding thereto. The aperture plate 24 is a metal plate provided with holes constituting apertures 12 and a large number of communication holes for effecting communication of the pressure chambers 10 and nozzles 8 corresponding thereto. The supply plate 25 is a metal plate provided with communicating holes for effecting communication of the apertures 12 and auxiliary manifold channels 5*a* and a large number of communicating holes for effecting communication of the pressure chambers 10 and nozzles 8 corresponding thereto. The manifold plates 26, 27, 28 are metal plates provided with holes constituting auxiliary manifold channels 5*a* and a large number of communication holes for effecting communication of the pressure chambers 10 and nozzles 8 corresponding thereto. The cover plate 29 is a metal plate provided with a large number of communicating holes for effecting communication of the pressure chambers 10 and nozzles 8 corresponding thereto. The nozzle plate 30 is a metal plate provided with a large number of nozzles 8. These nine metal plates are laminated in mutual positional alignment so as to form the individual ink channels 32.

As shown in FIG. 4, an actuator unit 21 has a laminated structure obtained by laminating four piezoelectric sheets 41, 42, 43, and 44. These piezoelectric sheets 41 to 44 are all of thickness about 15 μm, so the thickness of the actuator unit 21 is about 60 μm. Each of the piezoelectric sheets 41 to 44 also constitutes a flat plate (continuous flat plate layer) in the form of a layer that is continuous such that each of the piezoelectric sheets 41 to 44 is arranged spanning a large number of pressure chambers 10 formed in a single ink discharge region in the head unit 13. The piezoelectric sheets 41 to 44 are made of lead zirconate titanate (PZT) based ferroelectric ceramic material.

Figure 5:
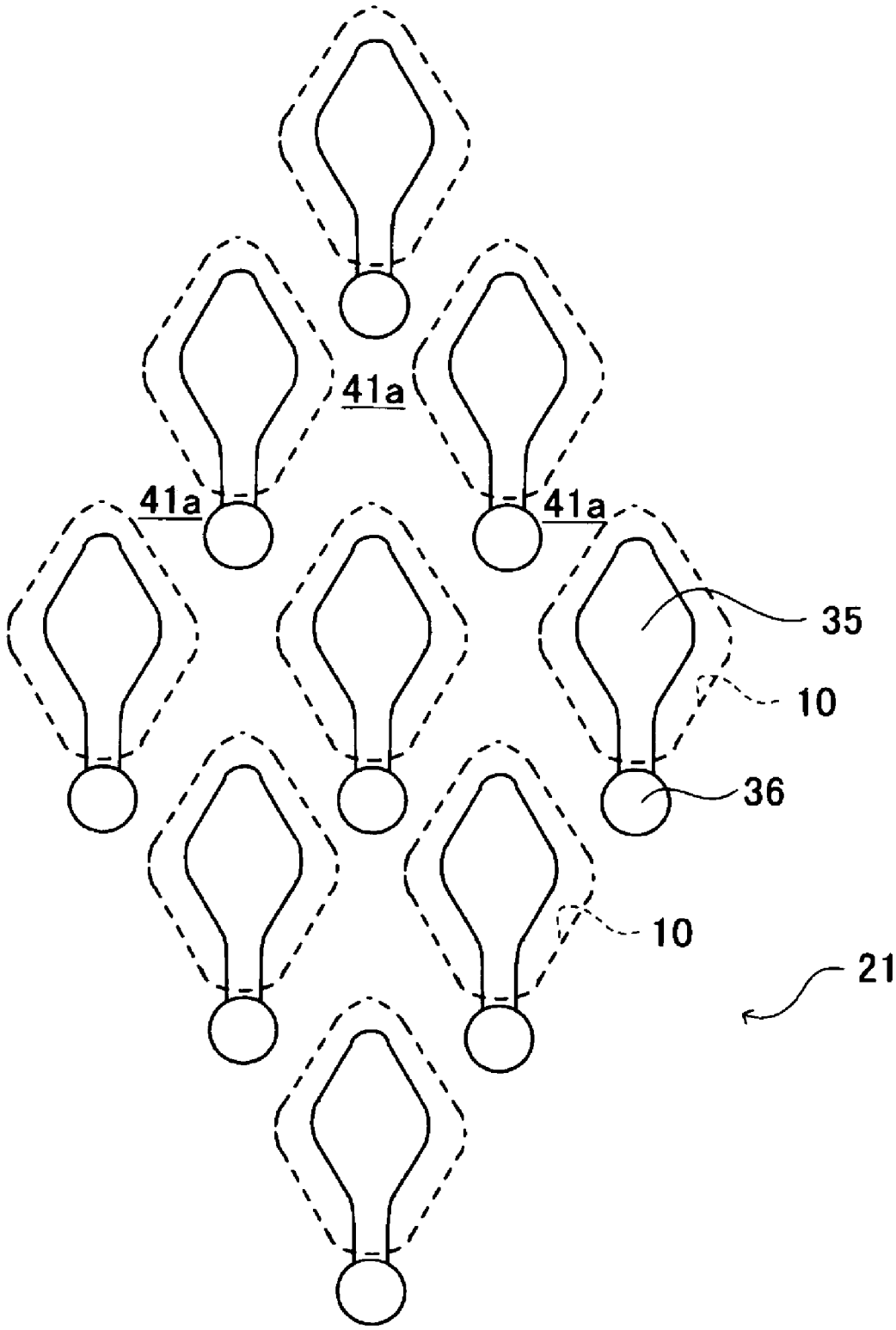
FIG. 5 is an enlarged plan view of a detail of the actuator unit depicted in FIG. 2.

Individual electrodes 35 of thickness about 1 μm are formed on the piezoelectric sheet 41 constituting the uppermost layer. The individual electrodes 35 and common electrodes 34, to be described, are both made of for example Ag—Pd based metallic material. As shown in FIG. 5, which is an enlarged plan view of a detail of an actuator unit 21, an individual electrode 35 has a substantially rhombus shape and is formed to positionally correspond to a pressure chamber 10 and such that the major part thereof is accommodated in the pressure chamber 10 in plan view. Consequently, as shown in FIG. 3, a large number of individual electrodes 35 are regularly arranged in two dimensions over substantially the entire region on the piezoelectric sheet 41 constituting the uppermost layer. In this embodiment, the individual electrodes 35 are formed only on the surface of the actuator unit 21, so only the piezoelectric sheet 41 constituting the outermost layer of the actuator unit 21 includes an active region. As a result, the deformation efficiency of unimorphous deformation in the actuator unit 21 is excellent.

An acute angle section of each individual electrode 35 (an acute angle nearer the long side of the actuator unit 21) extends to a column section 41*a* of the cavity plate 22 in plan view (portion where no pressure chamber 10 is formed in the cavity plate 22). Column sections 41*a* are stuck onto the actuator unit 21 and thereby support the actuator unit 21. A land 36 of thickness about 15 μm is formed on the vicinity of the leading end of an extended section thereof. The individual electrode 35 and the land 36 are electrically coupled. The land 36 is made of gold containing for example glass frit. The land 36 is a member that electrically connects the individual electrode 35 and a contact formed on the FPC.

A common electrode 34 of thickness about 2 μm formed on the entire sheet is interposed between the piezoelectric sheet 41 constituting the uppermost layer and the piezoelectric sheet 42 on the underside thereof. It should be noted that no electrode is arranged between the piezoelectric sheet 42 and piezoelectric sheet 43.

The common electrode 34 is earthed in a region not shown. In this way, the common electrode 34 is maintained equally at ground potential in the region positionally corresponding to all of the pressure chambers 10. A large number of individual electrodes 35 are respectively electrically connected with a drive IC, not shown, constituting part of a control section 100, individually through contacts on the FPC and wiring, in order to make it possible to control the potentials of these individually.

The operation of the actuator units 21 will now be described. In the actuator unit 21, of the four piezoelectric sheets 41 to 44, only the piezoelectric sheet 41 is polarized in a direction towards the common electrode 34 from the individual electrode 35. When the individual electrode 35 is set at a prescribed positive potential by applying a drive signal from the drive IC, a region (i.e. the "active region") in the piezoelectric sheet 41 facing the individual electrode 35 is contracted in the direction normal to the direction of polarization, due to the piezoelectric effect. No spontaneous contraction takes place in the other piezoelectric sheets 42 to 44, since no electrical field is applied thereto. Consequently, overall, unimorphous deformation takes place producing a convexity on the side of the pressure chamber 10 in the portion positionally corresponding to the active region in the piezoelectric sheets 41 to 44. When this happens, the volume of the pressure chamber 10 is lowered, causing the pressure of the ink to rise, with the result that ink is discharged from the nozzle 8 shown in FIG. 4. After this, when the individual electrode 35 returns to ground potential, the piezoelectric sheets 41 to 44 return to their original shape and the pressure chamber 10 also returns to its original volume. Consequently, the ink is sucked into the individual ink channel 32 from the auxiliary manifold channel 5*a*.

In another method of drive, a positive potential is applied beforehand to the individual electrodes 35. Each individual electrode 35 in respect of which there is a request for ink discharge is first set at ground potential and the individual electrode 35 is then again set to positive potential with a prescribed timing. In this case, by the return to the original condition of the piezoelectric sheets 41 to 44 with the timing at which the individual electrode 35 becomes ground potential, the volume of the pressure chamber 10 is increased compared with its initial condition (condition in which voltage was applied thereto beforehand), with the result that ink is sucked into the individual ink channel 32 from the auxiliary manifold channel 5*a*. After this, with the timing with which positive potential is again applied to the individual electrode 35, the positionally corresponding to the active region in the piezoelectric sheets 41 to 44 is deformed so as to present a convexity at the side of the pressure chamber 10, lowering the volume of the pressure chamber 10 and thereby raising the pressure of the ink and consequently causing ink to be discharged from the nozzle 8.

Figure 6:
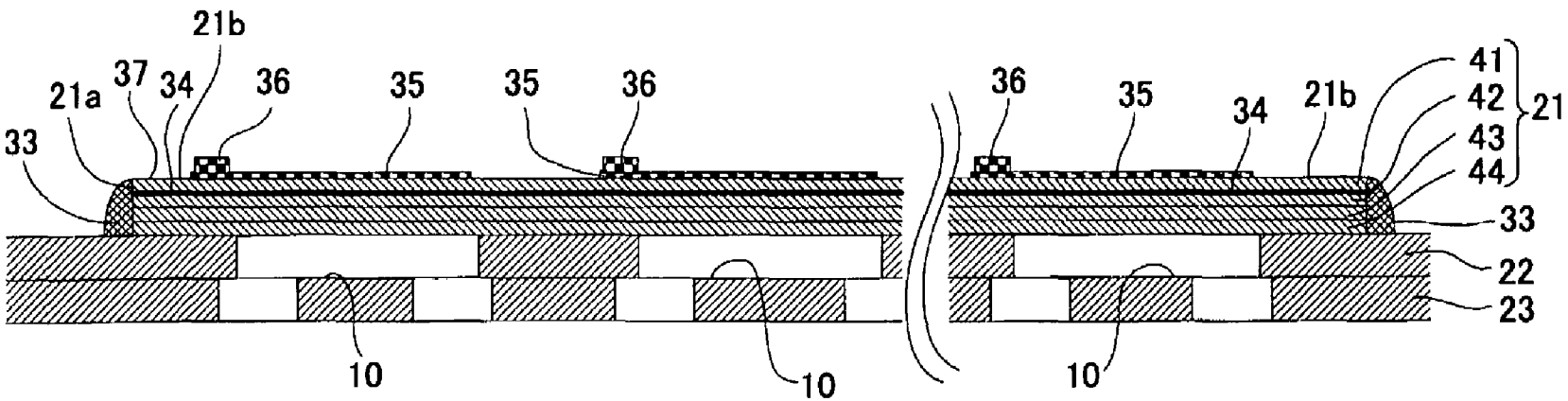
FIG. 6 is a cross-sectional view of a detail taken along the line VI-VI of FIG. 3.
Figure 7:
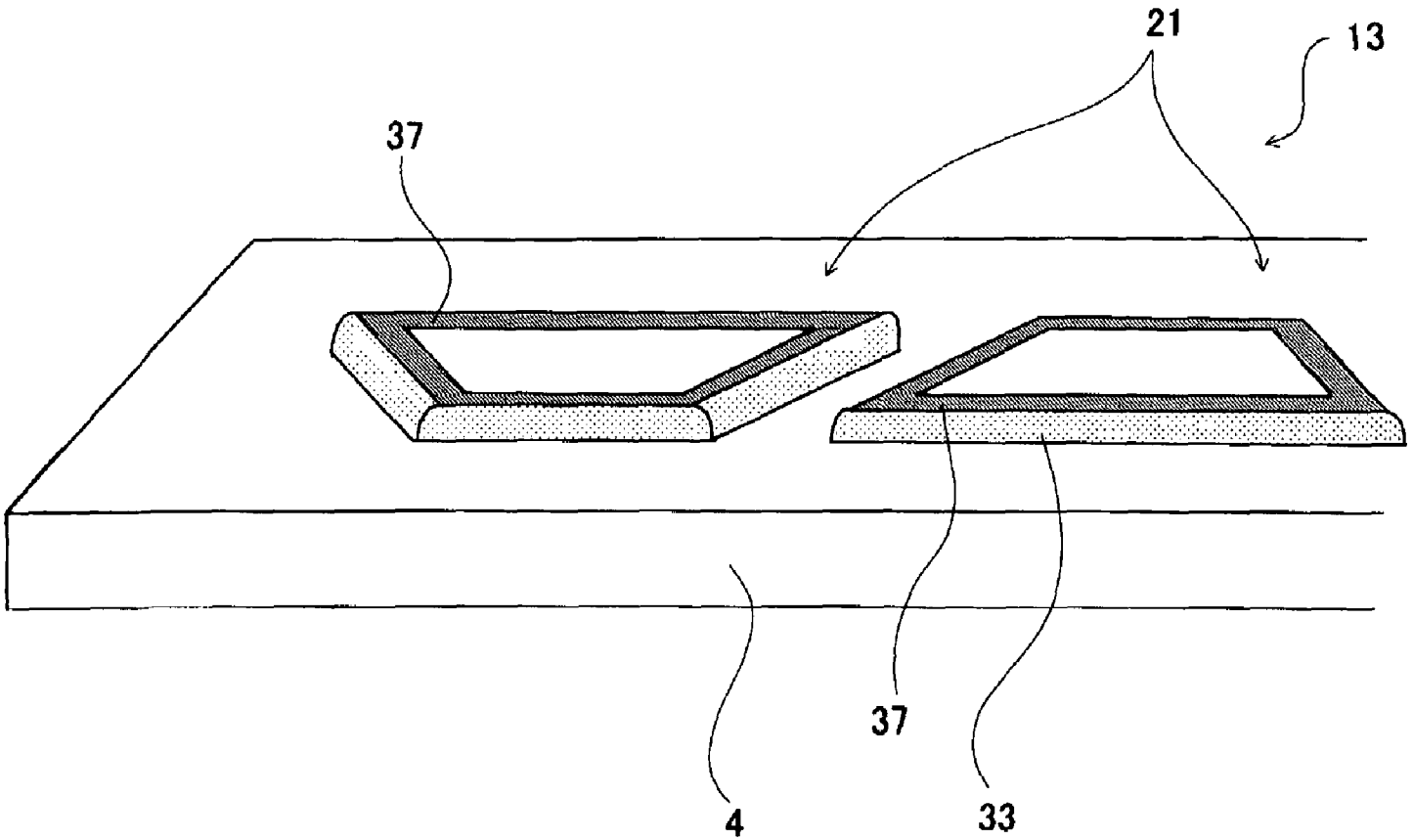
FIG. 7 is a perspective view of a detail of the head unit.

FIG. 6 is a cross-sectional view taken along the line IV-IV of FIG. 3. FIG. 7 is a perspective view of a detail of the head unit 13. As shown in FIG. 6 and FIG. 7, the four end faces 21*a* of the actuator units 21, which are substationally orthogonal to the upper surface of the cavity plate 22 and are of trapezoidal shape in plan view, are sealed by an adhesive layer 33 over the entire region from the lower end to the upper end thereof. As will be described, adhesive is employed for sticking together the channel unit 4 and the actuator units 21; in fact the adhesive layer 33 is formed on the end face 21*a* by extrusion of the adhesive to the outside from between both of these units upon application of pressure when these units are stuck together.

The surface roughness (in the present specification, this means the "arithmetical average roughness Ra") of the end face 21*a* of the actuator unit 21 is about 0.33 μm and the surface roughness of the upper face 21*b* of the actuator unit 21 is about 0.10 μm.

The surface roughness of the end face 21*a* and the upper face 21*b* can be measured using a laser microscope (VK8510, available from KEYENCE JAPAN). Specifically, the end surface 21*a* and the upper face 21*b* are irradiated with light having a wavelength of 685 nm from a semiconductor laser light source, and data on unevenness of these faces are gathered at a resolution of 0.01 μm in the height direction. The irradiation with the laser light is conducted through an object lens with a magnification of 50 times. Measuring interval is 250 μm in a distance of a straight line. This measurement gives a curved line with respect to the surface roughness. An average line is obtained from the curved line. Absolute values on deviation from the average line to the curved line are calculated and all of the absolute values are added up and then an arithmetic mean thereof is calculated. This measurement is repeated three times to give three arithmetic means. These arithmetic means are added up and the sum thereof is divided by the number of times on measurement (i.e., three), giving a surface roughness Ra. Further, with respect to the end face 21*a*, the actuator unit 21 is allowed to, using a jig, stand vertically on a flat plate and be fixed thereto, and then the surface roughness of the end face 21*a* is measured. With respect to the upper face 21*b*, the actuator unit 21 is placed on the flat plate and then the surface roughness of the upper face 21*b* is measured.

In common, when liquid comes in contact with solid face and a surface roughness of the solid face is relatively larger, a contact angle therebetween tends to become smaller. In other words, when a surface roughness of solid face becomes larger, a wettability of liquid contacting with the solid face becomes higher.

In an inkjet head 2 according to this embodiment, as described above, the thickness of the actuator unit 21 is about 60 μm and the surface roughness of the end face 21*a* is about 0.33 μm, while the surface roughness of the upper face 21*b* is about 0.10 μm. In this way, the force generated by for example surface tension with which the adhesive tries to climb the end face 21*a* can be made an appropriate magnitude such that no adhesive layer 33 is formed on the upper face 21*b* but the end face 21*a* is sealed by an adhesive layer 33. As a result, the disadvantages produced by exposure of the piezoelectric sheets 41 to 44 from the end face 21*a* of the actuator unit 21, in other words impairment of electrical insulation, resistance to humidity and mechanical strength of the actuator 21, can be prevented and, in addition, obstruction of drive of the actuator unit 21 by an adhesive layer 33 adhering to the upper face 21*b* is eliminated. In particular, since the entire region of the end face 21*a* is sealed, there is a marked effect in preventing impairment of electrical insulation, resistance to humidity and mechanical strength of the actuator 21.

As will be described in the following embodiment, the benefits described above can be obtained by adopting a thickness of the actuator unit 21 in the range of 20 μm to 100 μm and by adopting a surface roughness of the end face 21*a* thereof in the range of 0.15 μm to 0.5 μm. Also, the surface roughness of the upper face 21*b* thereof is preferably in the range of 0.08 μm to 0.12 μm.

As shown in FIG. 6, in an inkjet head 2 according to this embodiment, the common electrode 34 is exposed at the end face 21*a* since it extends to the periphery of the piezoelectric sheet 42. In this way, an actuator unit 21 of higher strength and better reliability can be obtained than in the case where the common electrode 34 does not extend to the periphery of the piezoelectric sheet 42. Furthermore, since, as described above, the entire region of the end face 21*a* is sealed by an adhesive layer 33, the common electrode 34 that is exposed at the end face 21*a* is necessarily covered by the adhesive layer 33. As a result, occurrences such as corrosion of the common electrode 34 due to entry of moisture into the actuator unit 21 from the interface between the common electrode 34 and the piezoelectric sheet 42 at the end face 21*a* of the actuator unit 21, or separation of the common electrode 34 from the piezoelectric sheets 41, 42 can be prevented.

The vicinity of the periphery of the upper face 21*b* of the actuator unit 21 (i.e., a continuous region from the intersection with the end face 21*a*) constitutes a water-repellent region 37 where water-repellent treatment is performed over the entire periphery. A coating film of a fluorine-based, silicone-based or silane-coupled agent is formed on the piezoelectric sheet 41 in the water-repellent region 37. As a result, the contact angle with water in the water-repellent region 37 is at least 70°. In common, it is known that the coating film of such water-repellent agents has poor affinity to adhesives such as epoxy-based thermosetting adhesives. Consequently, even if the adhesive reaches the upper edge (intersection of the end face 21*a* and upper face 21*b*) of the end face 21*a*, penetration thereof into the water-repellent region 37 cannot occur. In this way, obstruction of drive of the actuator unit 21 due to adhesion of adhesive on the individual electrodes 35 is effectively prevented.

Also, since the water-repellent region 37 is formed over the entire periphery of the upper face 21*b* of the actuator unit 21, penetration of adhesive into the upper face 21*b* from anywhere in the upper edge of the end face 21*a* can easily be prevented.

Figure 8:
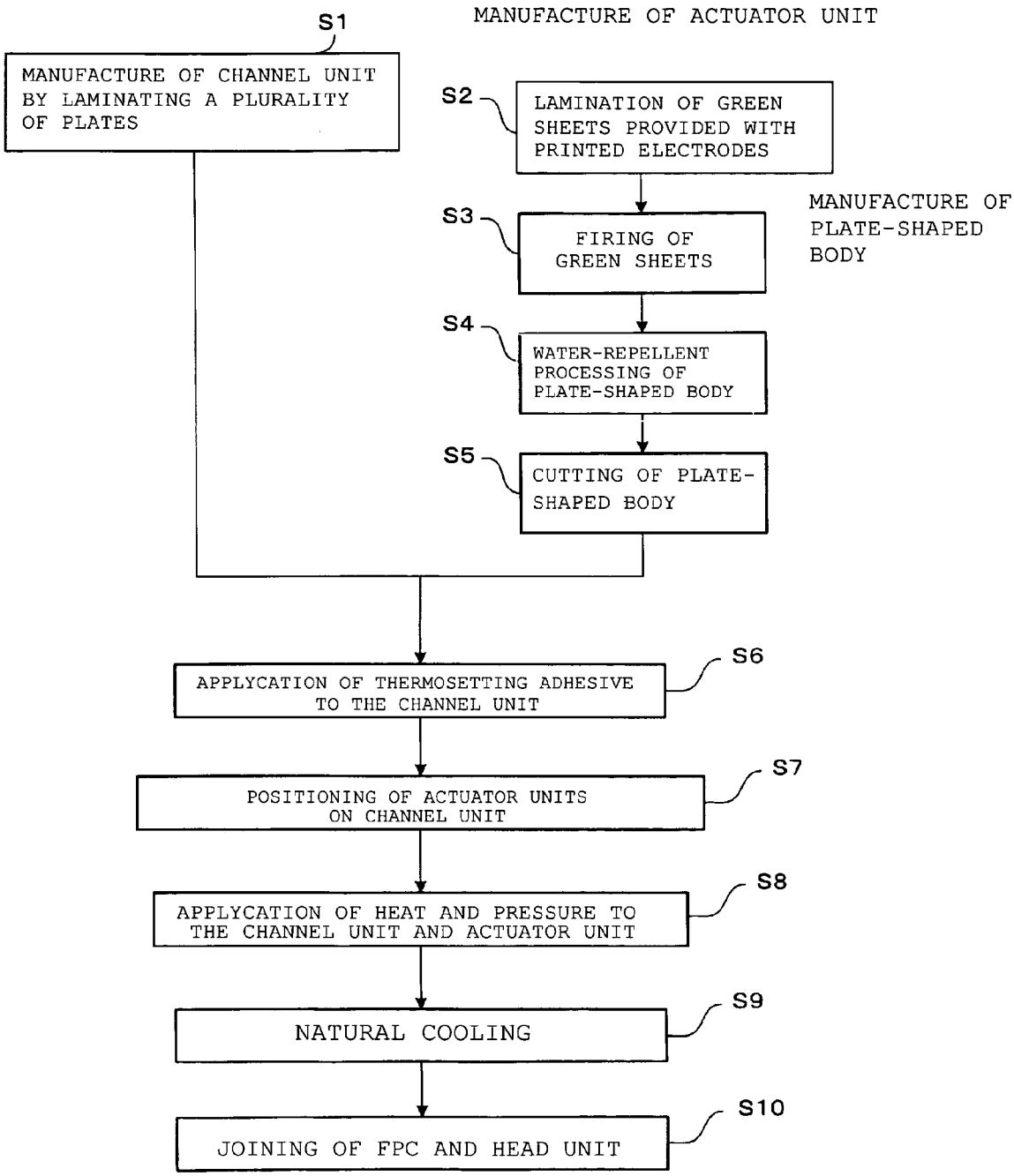
FIG. 8 is a view showing a step in manufacturing an inkjet head shown in FIG. 2.

Next, a method of manufacturing an inkjet head according to this embodiment will be described with reference to FIG. 8 to FIG. 11. FIG. 8 is a view showing a step in manufacturing an inkjet head 2.

In order to manufacture the inkjet head 2, the components such as the channel unit 4 and actuator unit 21 are separately manufactured and these various components are then assembled. First of all, in step 1 (S1), the channel unit 4 is manufactured. In order to manufacture the channel unit 4, etching is performed on the plates 22 to 30, using patterned photoresist as a mask. Holes as shown in FIG. 4 are thereby formed in the plates 22 to 30. After this, the nine plates 22 to 30 are positionally aligned and superimposed using an epoxy-based thermosetting adhesive. These nine plates 22 to 30 are then heated under pressure to a temperature of at least the hardening temperature of the thermosetting adhesive. In this way, the thermosetting adhesive is hardened and the nine plates 22 to 30 are mutually fixed to obtain a channel unit 4 as shown in FIG. 4.

In order to manufacture the actuator unit 21, First of all, in step 2 (S2), four green sheets of piezoelectric ceramic are prepared. The longitudinal and transverse dimensions of these green sheets are about 4 to 5 times those of the piezoelectric sheets 41 to 44. The green sheets are formed taking into account the amount of contraction produced by firing. Screen-printing of conductive paste in the pattern of common electrodes 34 is performed in nine locations (3 rows×3 columns) of a single green sheet, of these four green sheets. The green sheet printed with the conductive paste in the pattern of the common electrodes 34 is then laid below a green sheet on which no conductive paste printing has been formed, while positionally aligning the green sheets using a jig. In addition, a further two green sheets that have not been subjected to conductive paste printing are placed below these.

Figure 9:
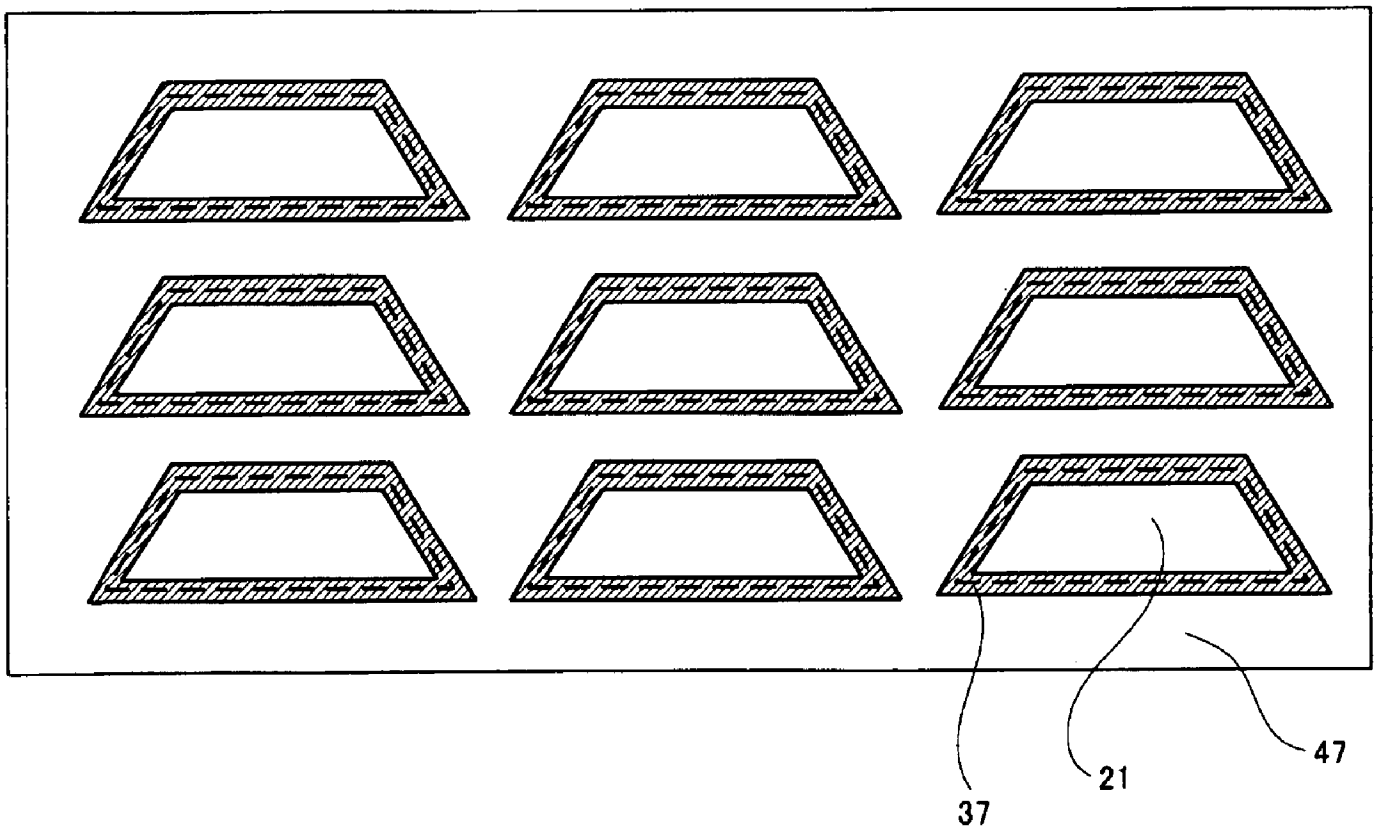
FIG. 9 is a plan view of a plate-shaped body formed in a step of manufacturing an actuator unit depicted in FIG. 2.

In step 3 (S3), the laminated body obtained in step 2 is degreased in the same way as in the case of known ceramics, and, in addition, is fired at a prescribed temperature. In this way, nine common electrodes 34 are produced from the conductive paste, while the four green sheets provide piezoelectric sheets. After this, screen-printing of conductive paste is respectively performed in the pattern of the individual electrodes 35 in the region positionally overlapping the nine common electrodes 34 in plan view in the piezoelectric sheet constituting the uppermost layer. A large number of individual electrodes 35 are then formed on the piezoelectric sheet constituting the uppermost layer by firing the conductive paste by heat treatment of the laminated body. After this, gold containing glass frit is printed onto the individual electrodes 35 to form a large number of lands 36. In this way, as depicted in FIG. 9, the plate-shaped body 47 having nine actuator units 21 integrated so as to form a single plane is obtained.

Next, in step 4 (S4), a water-repellent region 37 is formed by performing water-repellent treatment in a strip-shaped region spanning the periphery of the upper face 21*b* of the 9 actuator units 21 contained in the plate-shaped body 47 and extending over the entire periphery thereof. After this, in step 5 (S5), the plate-shaped body 47 is cut using a dicing saw or wire saw along the peripheries of the upper faces 21*b* of the actuator units 21 in the water-repellent region 37. The actuator units 21 can be manufactured by the steps up to this point. Since the actuator units 21 are manufactured by undergoing a cutting step such as step 5, the surface roughness of the end faces 21*a* of the actuator units 21 has a value that is larger than the surface roughness of the upper face 21*b* without needing to perform a separate step. However, in order to ensure a surface roughness as described above, selection of the cutting tool is important.

It should be noted that, since the channel unit manufacturing step of step 1 and the actuator unit manufacturing step of steps 2 to 5 are independently performed, either of these may be performed first, or they may be performed in parallel.

Figure 10:
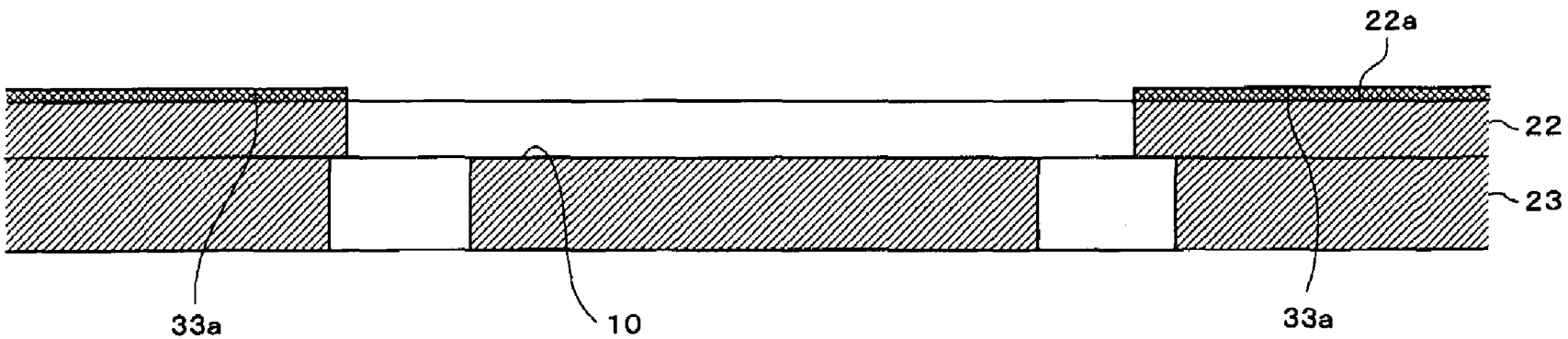
FIG. 10 is a cross-sectional view depicting the manufacturing step of an inkjet head depicted in FIG. 2.

Next, in step 6 (S6), as shown in FIG. 10, epoxy-based thermosetting adhesive C is applied using a bar coater to the face 22*a* provided with a large number of recesses corresponding to the pressure chambers of the channel unit 4 obtained in step 1. The epoxy-based thermosetting adhesive has a viscosity of 0.33 Pa·s at room temperature and has a thermosetting temperature of about 80° C. The thickness of the adhesive applied on the face 22*a* is about 1 μm. As the thermosetting adhesive, for example an adhesive of the two-liquid mixing type may be employed.

Next, in step 7 (S7), the actuators 21 are placed on the thermosetting adhesive layer that was applied to the channel unit 4. At this time, The actuator units 21 are located in position with respect to the channel unit 4 such that the individual electrodes 35 positionally correspond to pressure chambers 10. This positioning is performed using positioning marks (not shown) formed in the channel unit 4 and actuator units 21 in the manufacturing steps (step 1 to step 5) beforehand.

Figure 11:
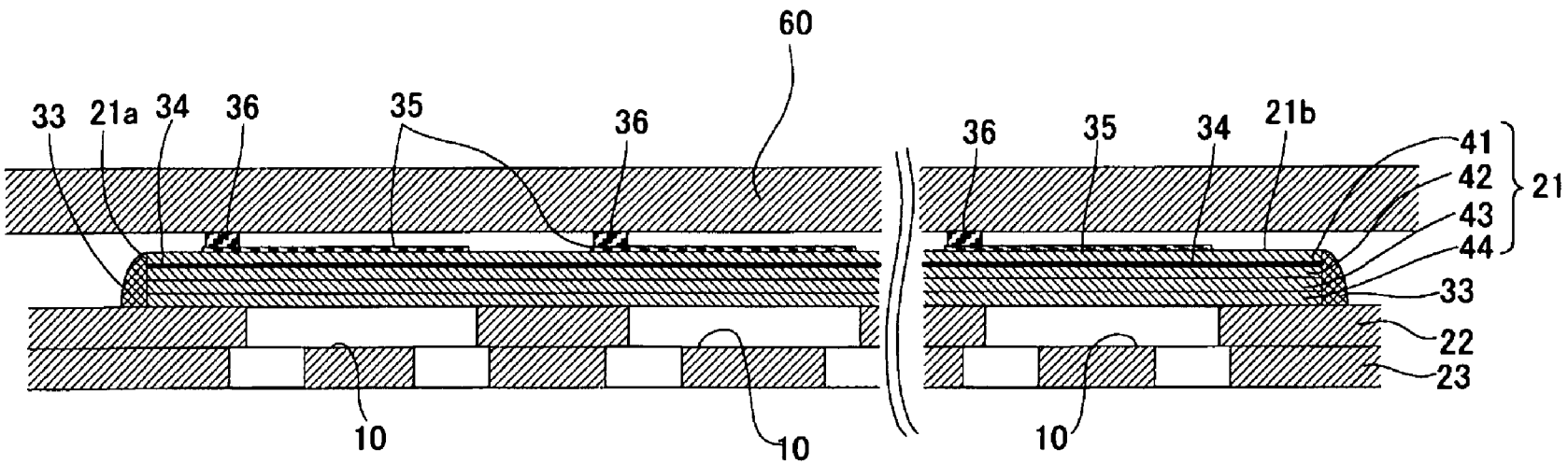
FIG. 11 is a cross-sectional view depicting a further manufacturing step of an inkjet head depicted FIG. 2.

Next, in step 8 (S8), as shown in FIG. 11, a ceramic heater 60 is placed on the actuator units 21 so as to be supported by lands 36. The laminated body of the channel unit 4 and actuator units 21 is then subjected to pressure heating to at least the hardening temperature of the thermosetting adhesive, using the ceramic heater 60. During this process, adhesive is extruded from the adhering faces of the actuator units 21 and channel unit 4 prior to hardening, and flows to the end face 21*a* of the actuator units 21. Although this depends on the rate of heating, the thermosetting adhesive temporarily becomes of extremely low viscosity and takes a liquid form. Consequently, due to surface tension, the thermosetting adhesive climbs up the end face having surface roughness as described above, even if this end face stands vertically. Specifically, the rate of heating of the adhesive is therefore determined in accordance with the height of the end face and/or its surface roughness, so that the adhesive is thus lowered in viscosity and the upper edge of the adhesive rises at least to a position higher than the common electrode that is exposed at the end face. In this embodiment, an adhesive layer 33 is formed that seals the entire region of the end face 21*a* of the actuator units 21. Thus, with the method of manufacture of this embodiment, without forming the adhesive layer 33 on the end face 21*a* of the actuator units 21 separately before or after the step of sticking together the channel unit 4 and the actuator units 21, an adhesive layer 33 can be formed in the step of sticking together the channel unit 4 and actuator units 21, so the inkjet head 2 can easily be manufactured. The laminated body that is extracted from the heating/pressurizing device is then allowed to cool naturally in step 9 (S9). A head unit 13 in which the end faces 21*a* of the actuator units 21 are sealed by an adhesive layer 33 can thus be manufactured.

After this, in step 10 (S10), the thermosetting conductive adhesive is applied onto the lands 36. The FPC and the head unit 13 are positionally aligned such that the contacts that are formed in the FPC and the conductive adhesive are superimposed. Then the FPC is heated and pressured towards the head unit B. The FPC and the head unit are thus stuck together. The inkjet head 2 is completed by the above step.

Also, in the method of manufacture described above, since adhesive having a viscosity of 0.33 Pa·s at room temperature is employed as the adhesive for sticking together the channel unit 4 and the actuator units 21, as will be clear from the embodiment to be described below, a better sealing condition of the end face 21*a* of the actuator units 21 is produced, thereby making it possible to more effectively prevent impairment of the electrical insulation properties, resistance to humidity and mechanical strength of the actuator units 21. It should be noted that, in this embodiment, the end faces of the actuator units 21 are formed by cutting the plate shaped body 47. While this expedient is adopted so that the desired surface roughness is obtained, depending on the cutting conditions, residual stress may be generated in the end face or, in some cases, a condition may be produced in which the end face cracks or grains of the piezoelectric sheet drops out of the end face. However, since the end face is well sealed by adhesive, any deficiencies of mechanical strength can be adequately made up. In addition, since the water-repellent treatment that is applied at the periphery of the actuator units 21 on the upper face 21*b* impedes spreading of the adhesive layer 33, obstruction of drive of the actuator units 21 by the adhesive layer 33 is minimized. In addition, the thickness of the adhesive layer 33 between the channel unit 4 and the actuator units 21 can be made extremely small, so the ink discharge performance is improved.

Also, since the plate-shaped body 47 is divided into nine actuator units 21 by cutting the plate-shaped body 47 after performing water-repellent treatment of the surface of the plate shaped body 47, it is possible to prevent accidental water-repellent treatment of the end faces 21*a* of the actuator units 21.

Second Embodiment

Next, an inkjet head according to a second embodiment of the present invention is described below with reference to FIG. 12. The inkjet head according to this embodiment differs from the inkjet head 2 of the first embodiment solely in that a step is formed on the end face of the actuator unit. The following description will therefore focus on the differences between these two. Also, members which are the same as in the description of the first embodiment are given the same reference symbols and further description thereof is dispensed with.

Figure 12:
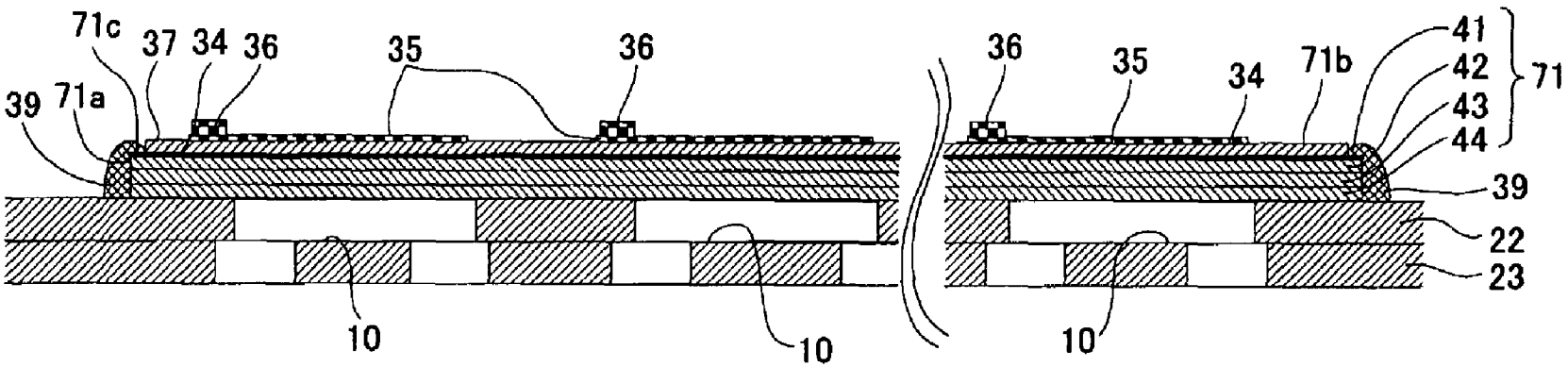
FIG. 12 is a cross-sectional view of a detail of an inkjet head constituting a second embodiment of the present invention.

As shown in FIG. 12, in an inkjet head according to this embodiment, an actuator unit 71 comprises four piezoelectric sheets 41', 42, 43, 44 of the same thickness. The piezoelectric sheet 41' is of slightly smaller planar size than the remaining three piezoelectric sheets 42 to 44. A step having an upwardly directed step face 71*c* is therefore formed over the entire periphery in the end face 71*a* of the actuator unit 71. A common electrode 34 is exposed at this end face 71*c*.

In order to form the actuator unit 71 provided with such a step in the end face 71*a*, for example, after separating a plate shaped body 47 into the nine actuator units in the same way as in the first embodiment described above, only the periphery of the piezoelectric sheet of the uppermost layer is cut away. Alternatively, before separating the plate shaped body 47 into the actuator units 71 by cutting, groove may be formed to a depth of about 10 μm beforehand, using for example a dicer. A groove is then produced having a width wider than the necessary cutting margin for cutting. Also, regarding the method of exposing the common electrode 34, the cutting depth may be determined such as to effect exposure thereof at the step face 71*c* as described above. Of course, in order to ensure electrical insulation, the side wall face and the step face 71*c* of the groove may be exposed and the adhesive may be allowed to climb by surface tension to a level higher than that of the location of such exposure.

The actuator units 71 manufactured in this way are then stuck onto a channel unit 4 in a heating and pressing step. In this process, in the same way as in the case of the first embodiment described above, the adhesive that is present between the actuator units 71 and the channel unit 4 is extruded from the adhering faces of the actuator units 71 and the channel unit 4 prior to hardening and flows onto the end face 71*a* of the actuator units 71, thereby forming an adhesive layer 39 that seals a region from the bottom end of the end face 71*a* of the actuator units 71 to the height of the step face 71*c*.

In an inkjet head according to this embodiment, just as in the case of the first embodiment, the thickness of the actuator units 71 is made about 60 μm and the surface roughness of the end faces 71*a* is made about 0.33 μm, while the surface roughness of the upper face 71*b* is made about 0.10 μm. Consequently, by making the force a suitable magnitude with which the adhesive tries to climb the end face 71*a*, the end face 71*a* is sealed by an adhesive layer 39 to the step face 71*c* but no adhesive layer 39 is formed on the upper face 71*b*. The force is generated by, for example, surface tension. Consequently, even with the inkjet head of this embodiment, the same benefits as in the case of the first embodiment, such as the benefit of preventing impairment of electrical insulation, resistance to humidity and mechanical strength of the actuator units 71 and the benefit of preventing obstruction of drive of the actuator unit 71 can be obtained. In particular, with an inkjet head according to this embodiment, deposition of adhesive onto the upper face 71*b* is impeded by the formation of the step.

EXAMPLES

Example 1

The state of sealing of the end face 21*a* and the state of adhesion of adhesive onto the upper face 21*b* of the actuator unit 21 were observed when only the thickness of the actuator unit 21 was varied in nine steps, namely, 10, 15, 20, 25, 40, 80, 100, 110, and 150 μm in an inkjet head 2 as described in the first embodiment. The results are shown in Table 1. The details of the inkjet head 2 that was used were as follows.

TABLE 1

| Actuator thickness (μm) | State of sealing of end face | State of adhesion of adhesive on upper face | Evaluation |
|---|---|---|---|
| 10 | good sealing | adhesion in a wide range | poor |
| 15 | good sealing | partial adhesion | moderate |
| 20 | good sealing | no adhesion | good |
| 25 | good sealing | no adhesion | good |
| 40 | good sealing | no adhesion | good |
| 80 | good sealing | no adhesion | good |
| 100 | good sealing | no adhesion | good |
| 110 | some poor sealing | no adhesion | moderate |
| 150 | poor sealing | no adhesion | poor |

In Table 1, "good sealing" means that sealing is effected uniformly without exposure of the end faces over the entire region. As can be seen from Table 1, the sealing state of the end face 21*a* of the actuator unit 21 is good in the range where the thickness of the actuator 21 is 10 μm to 100 μm; and in order to prevent adhesive from adhering to the upper face 21*b* of the actuator unit 21, it is necessary to make the thickness of the actuator unit 21 at least 20 μm. Viewing these two results together, it can be seen that, if a thickness range of the actuator unit 21 of 20 μm to 100 μm is adopted, a good sealing state of the end face 21*a* can be achieved and adhesion of adhesive to the upper face 21*b* thereof can be prevented. In particular, allowing for a margin in respect of the state of sealing of the end face 21*a* and the state of adhesion of the adhesive onto the upper face 21*b*, the thickness of the actuator unit 21 is preferably 40 μm to 80 μm.

Example 2

In an inkjet head 2 as described in the first embodiment, the state of sealing of the end face 21*a* of the actuator unit 21 was observed when the thickness of the actuator unit 21 was made 20 μm and the surface roughness of the end face 21*a* was varied in nine steps, namely, 0.10, 0.13, 0.15, 0.20, 0.30, 0.40, 0.50, 0.60 and 0.80 (the surface roughness of the upper face 21*b* was about 0.10 μm). The results are shown in Table 2. Likewise, the adhesion state of the adhesive onto the upper face 21*b* of the actuator unit 21 was observed when the thickness of the actuator unit 21 was made 20 μm and the surface roughness of the upper face 21*b* was varied in five steps, namely, 0.08, 0.10, 0.12, 0.14 and 0.16 (the surface roughness of the end face 21*a* was about 0.33 μm). The results are shown in Table 3. It should be noted that the viscosity of the adhesive constituting the adhesive layer 33 used in order to stick together the actuator unit 21 and the channel unit 4 was then 1.0 Pa·s at room temperature, and the thickness of the adhesive applied on the channel unit 4 was 1 μm to 4 μm. Also, the surface roughness of the end face 21*a* was varied by suitably adjusting the whetstone grain size (for example #2000, #1500, #1200, #1000) used in the dicing saw for cutting the plate-shaped body 47, and the speed of rotation of the tool. The surface roughness of the upper face 21*b* was varied by adjusting the average crystal grain size by altering the firing temperature of the raw-material powder with average particle size of 0.80 μm to 1.0 μm in the range 1040 to 1100° C.

TABLE 2

| End face surface roughness Ra (μm) | State of sealing of end face | Whetstone grain size | Evaluation |
|---|---|---|---|
| 0.10 | partial failure of adhesion by the adhesive | #2000 | moderate |
| 0.13 | good sealing | #2000 | good |
| 0.15 | good sealing | #2000 | good |
| 0.20 | good sealing | #2000 | good |
| 0.30 | good sealing | #1500 | good |
| 0.40 | good sealing | #1500 | good |
| 0.50 | good sealing | #1500 | good |
| 0.60 | chipping occurs, with inflow of adhesive into the chipping | #1200 | poor |
| 0.80 | chipping occurs, with inflow of adhesive into the chipping | #1200 | poor |

TABLE 3

| Upper face surface roughness Ra (μm) | State of adhesion of adhesive on upper face | Average crystal grain size (μm) | Evaluation |
|---|---|---|---|
| 0.08 | no adhesion | 2.2 | good |
| 0.10 | no adhesion | 2.4 | good |
| 0.12 | no adhesion | 2.8 | good |
| 0.14 | adhesive permeates from the end face to the upper face | 3.1 | poor |

TABLE 3-continued

| Upper face surface roughness Ra (μm) | State of adhesion of adhesive on upper face | Average crystal grain size (μm) | Evaluation |
|---|---|---|---|
| 0.16 | adhesive permeates and spreads from the end face to the upper face | 3.9 | poor |

The same tests as shown in Table 2 and Table 3 were conducted using the actuator unit 21 with a thickness of 40 μm. The results are shown in Table 4 and Table 5. The viscosity of the adhesive which was then used was 1.0 Pa·s at room temperature and the thickness of the adhesive applied on the channel unit 4 was 4 μm to 8 μm.

TABLE 4

| End face surface roughness Ra (μm) | State of sealing of end face | Whetstone grain size | Evaluation |
|---|---|---|---|
| 0.10 | partial failure of adhesion by the adhesive | #2000 | moderate |
| 0.13 | partial failure of adhesion value adhesive | #2000 | moderate |
| 0.15 | good adhesion | #2000 | good |
| 0.20 | good adhesion | #2000 | good |
| 0.30 | good adhesion | #1500 | good |
| 0.40 | good adhesion | #1500 | good |
| 0.50 | good adhesion | #1500 | good |
| 0.60 | good adhesion | #1200 | good |
| 0.80 | Chipping occurs in some parts, with inflow of adhesive into the chipping | #1000 | moderate |

TABLE 5

| Upper face surface roughness Ra (μm) | State of adhesion of adhesive on upper face | Average crystal grain size (μm) | Evaluation |
|---|---|---|---|
| 0.08 | no upper face adhesion | 2.1 | good |
| 0.10 | no upper face adhesion | 2.3 | good |
| 0.12 | no upper face adhesion | 2.9 | good |
| 0.14 | adhesive penetrates from the end face to part of the upper face edge | 3.2 | moderate |
| 0.16 | adhesive penetrates and spreads from the end face to part of the upper face edge | 3.9 | poor |

The same tests as shown in Table 2 and Table 3 were conducted using the actuator unit 21 with a thickness of 80 μm. The results are shown in Table 6 and Table 7. The viscosity of the adhesive which was then used was 5.0 Pa·s at room temperature and the thickness of the adhesive applied on the channel unit 4 was 7 μm to 12 μm.

TABLE 6

| End face surface roughness Ra (μm) | State of sealing of end face | Whetstone grain size | Evaluation |
|---|---|---|---|
| 0.10 | failure of adhesion by the adhesive | #2000 | poor |
| 0.13 | partial failure of adhesion by the adhesive | #2000 | moderate |
| 0.15 | good sealing | #2000 | good |
| 0.20 | good sealing | #2000 | good |
| 0.30 | good sealing | #1500 | good |
| 0.40 | good sealing | #1500 | good |
| 0.50 | good sealing | #1500 | good |
| 0.60 | partially unsealed portions generated due to insufficient fluidity of adhesive | #1200 | moderate |
| 0.80 | chipping occurs, with inflow of adhesive into the chipping | #1000 | poor |

TABLE 7

| Upper face surface roughness Ra (μm) | State of adhesion of adhesive on upper face | Average crystal grain size (μm) | Evaluation |
|---|---|---|---|
| 0.08 | no adhesion | 2.2 | Poor |
| 0.10 | no adhesion | 2.4 | Poor |
| 0.12 | no adhesion | 2.8 | Poor |
| 0.14 | Adhesive permeates into part of the edge of the upper face from the end face | 3.1 | moderate |
| 0.16 | Adhesive permeates into part of the edge of the upper face from the end face | 3.9 | Moderate |

As can be seen from Table 2, Table 4 and Table 6, irrespective of the thickness of the actuator unit 21, in order to achieve a good state of sealing of the end face, the surface roughness of the end face 21*a* should be in the range of 0.15 μm to 0.5 μm, more preferably 0.20 μm to 0.4 μm. Also, as can be seen from Table 3, Table 5 and Table 7, in order to ensure that no adhesive adheres to the upper face 21*b* of the actuator unit 21, the surface roughness of the upper face 21*b* should be in the range 0.08 μm to 0.12 μm, more preferably 0.08 μm to 0.10 μm.

Example 3

The state of sealing of the end face 21*a* of the actuator unit 21 and the state of adhesion of the adhesive onto the upper face 21*b* were observed when the viscosity of the adhesive used for sticking together the actuator unit 21 and the channel unit 4 was varied in seven steps, namely, 0.3, 0.5, 1.0, 3.0, 5.0, 8.0, and 9.0 Pa·s at room temperature, while varying the thickness of the actuator unit 21 in nine steps, namely, 10, 15, 20, 25, 40, 80, 100, 110, and 150 μm, for each of the first-mentioned steps, with an inkjet head 2 as described in the first embodiment. The results are shown in Table 8. The conditions other than thickness of the actuator unit 21 and viscosity of the adhesive were the same as in the case of Example 1.

TABLE 8

| Viscosity of adhesive (Pa · s) | Thickness of actuator unit (μm) | | | | | | | | |
|---|---|---|---|---|---|---|---|---|---|
| | 10 | 15 | 20 | 25 | 40 | 80 | 100 | 110 | 150 |
| 0.3 | B | B | C | C | C | C | C | C | C |
| 0.5 | B | B | A | A | A | B | B | C | C |
| 1.0 | B | B | A | A | A | B | B | C | C |
| 3.0 | C | B | A | A | A | A | A | B | B |
| 5.0 | C | C | A | A | A | A | A | B | C |
| 8.0 | C | C | B | A | A | A | A | C | C |
| 9.0 | C | C | C | C | C | B | B | B | C |

Notes of FIG. 8
"A": good end face sealing and no adhesion to the upper face
"B": partially poor end face sealing or partial adhesion to the surface
"C": poor end face sealing or severe adhesion to the surface As described with reference to Example 1, in order to achieve a good sealing state of the end face 21*a* and prevent adhesion of adhesive to the upper face 21*b*, it is necessary to ensure that the thickness of the actuator unit 21 is in the range of 20 μm to 100 μm. Also, it can be seen from Table 8 that, if the thickness of the actuator unit 21 is in the range 20 μm to 100 μm, it is necessary to employ adhesive of viscosity in the range 0.5 Pa·s to 8.0 Pa·s at room temperature. The reason for this is that, if the thickness of the actuator unit 21 is in the range of 20 μm to 100 μm, a good sealing state of the end face 21*a* and prevention of adhesion of adhesive to the upper face 21*b* can be achieved by suitably adjusting the viscosity of the adhesive in the range 0.5 Pa·s to 8.0 Pa·s. In particular, it is desirable from the point of view of dealing with fluctuation of thickness of the actuator unit 21 in a wide range that the viscosity should be 3.0 Pa·s to 5.0 Pa·s. Thus, the adoption of a suitable value for the viscosity of the adhesive is important from the point of view of ensuring that impairment of electrical insulation, resistance to humidity and mechanical strength of the actuator unit 21 is prevented and drive of the actuator unit 21 is not obstructed by the adhesive layer 33.

While preferred embodiments of the present invention have been described above, the present invention is not restricted to the above embodiments and can be modified in various ways within the limits set out in claims. For example, in the first embodiment, the entire region of the end face 21*a* of the actuator unit 21 was sealed by an adhesive layer 33, but it would also be possible to seal only part of the end face 21*a* of the actuator unit 21. Also, in this case, it is desirable, as in the second embodiment, to seal the end face 21*a* with an adhesive layer 33 at least to such a height that common electrode 34 is covered. It should be noted that this does not apply if the common electrode 34 is not exposed at the end face 21*a* of the actuator unit 21.

Also, in the first embodiment, the vicinity of the periphery of the upper face 21*b* of the actuator unit 21 was constituted as a water-repellent region 37 over the entire periphery, but it is not necessarily essential to form such a water-repellent region 37. Also, even in the case where a water-repellent region 37 is formed, is not necessary to form the water-repellent region 37 over the entire vicinity of the periphery of the upper face 21*b*. For example, a water-repellent region 37 may be formed in a peripheral region in the upper face 21*b* of the actuator unit 21 where individual electrodes 35 are more closely arranged. In this embodiment, only peripheral region corresponding to the two inclined sides of the actuator unit 21 may constitute a water-repellent region 37 and, in this way, even if adhesive climbs to the upper face 21*b*, there is no possibility of obstructing the displacement of the active region adjacent to the peripheral region.

In addition, in manufacturing an inkjet head according to the first embodiment, instead of forming the adhesive layer 33 simultaneously in the step of sticking the channel unit 4 onto the actuator unit 21, it is possible to carry out a step of forming the adhesive layer 33 on the end face 21*a* of the actuator unit 21 as a separate step after the step of sticking together the channel unit 4 and the actuator unit 21.

Also, although, in the first embodiment, the plate-shaped body 47 in which a plurality of actuator units 21 were integrated was provided with a water-repellent region 37 prior to separation of the nine actuator units 21 by cutting, it would also be possible to form the water-repellent region 37 after separation of the nine actuator units 21 by cutting up the plate-shaped body 47. Also, the material of the member that is used to seal the end face 21*a* of the actuator unit 21 is not restricted to being an adhesive and the end face 21*a* could be sealed with a resin film made of any desired resin.

Although, in the embodiments described above, the individual electrodes 35 were formed on the upper face 21*a* of the actuator unit 21, it would also be possible to form the individual electrodes 35 in a location other than the upper face 21*a* of the actuator unit 21, such as between the piezoelectric sheet 42 and the piezoelectric sheet 43.

In the present embodiment, conductive adhesive is employed for joining the actuator unit 21 and the FPC 50, but it would be possible to join these two with a bonding agent such as solder. Also, although the inkjet head of this embodiment is of the line type, the present invention could also be applied to inkjet heads of the serial type.

The entire disclosure of the specification, claims, summary and drawings of Japanese Patent Application No. 2004-287720 filed on Sep. 30, 2004 is hereby incorporate by reference.

What is claimed is:

1. An inkjet head comprising:

a channel unit having a plurality of nozzles and a plurality of pressure chambers respectively communicating with the nozzles; and an actuator unit on the channel unit and having a piezoelectric sheet, a plurality of individual electrodes arranged to positionally correspond to the pressure chambers respectively and a common electrode sandwiching the piezoelectric sheet together with the plurality of individual electrodes, wherein the actuator unit has a thickness of 20 μm to 100 μm and a surface roughness of the end face of the actuator unit including an intersection with the channel unit is 0.15 μm to 0.5 μm, and at least a part of the end face is sealed by a resin film.

2. The inkjet head according to claim 1, wherein, in the actuator unit, a surface roughness of a face opposite to the face that is stuck onto the channel unit is 0.08 μm to 0.12 μm.

3. The inkjet head according to claim 1, wherein an entire region of the end face is sealed by the resin film.

4. The inkjet head according to claim 1, wherein, on the face opposite to the face that is stuck onto the channel unit, water-repellent treatment is applied to a region that is continuous from the intersection with the end face.

5. The inkjet head according to claim 4, wherein the region where the water-repellent treatment is applied is formed over an entire periphery on the face of the actuator unit.

6. The inkjet head according to claim 4, wherein a film of a fluorine-based, silicone-based or silane-coupling agent is formed on the water-repellant treated region.

7. The inkjet head according to claim 1, wherein the common electrode extends to a periphery of the piezoelectric sheet so as to be exposed at the end face; and the resin film seals the end face at least up to the height such that the common electrode exposed at the end face is covered.

8. The inkjet head according to claim 7, wherein an entire region of the end face is sealed by the resin film.

9. The inkjet head according to claim 1, wherein the actuator unit includes a plurality of piezoelectric sheets and the end face of each piezoelectric sheet is sealed by a resin film.

10. An inkjet head comprising:

a channel unit having a plurality of nozzles and a plurality of pressure chambers respectively communicating with the nozzles; and an actuator unit on the channel unit and having a piezoelectric sheet, a plurality of individual electrodes arranged to positionally correspond to the pressure chambers respectively and a common electrode sandwiching the piezoelectric sheet together with the plurality of individual electrodes, wherein a surface roughness of the end face of the actuator unit including an intersection with the channel unit is 0.15 μm to 0.5 μm.

11. The inkjet head according to claim 10, wherein the actuator unit includes a plurality of piezoelectric sheets and the end face of each piezoelectric sheet is sealed by a resin film.

* * * * *